US008196915B2

(12) United States Patent
Hirabayashi et al.

(10) Patent No.: US 8,196,915 B2
(45) Date of Patent: Jun. 12, 2012

(54) SHEET RETURNING UNIT FOR POST PROCESSING APPARATUS

(75) Inventors: Takeshi Hirabayashi, Aichi (JP); Shigefumi Soga, Aichi (JP); Terumitsu Azuma, Aichi (JP); Kentaro Fukami, Aichi (JP); Shinji Tanoue, Aichi (JP); Hiroki Yoshida, Aichi (JP); Toshikazu Satoh, Aichi (JP); Daishi Watanabe, Aichi (JP); Kazumasa Takeuchi, Aichi (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 12/923,298

(22) Filed: Sep. 14, 2010

(65) Prior Publication Data

US 2011/0074081 A1 Mar. 31, 2011

(30) Foreign Application Priority Data

Sep. 29, 2009 (JP) ..... 2009-224410

(51) Int. Cl.
*B65H 37/04* (2006.01)

(52) U.S. Cl. ..... 270/58.11; 270/58.12; 270/58.16

(58) Field of Classification Search ..... 270/58.08, 270/58.11, 58.12, 58.16
See application file for complete search history.

(56) References Cited

U.S. PATENT DOCUMENTS

| | | | | |
|---|---|---|---|---|
| 6,398,203 | B1 * | 6/2002 | Saito et al. | 270/58.12 |
| 6,601,840 | B2 * | 8/2003 | Boss et al. | 270/58.08 |
| 6,802,501 | B2 * | 10/2004 | Boss et al. | 270/58.07 |
| 6,952,202 | B2 | 10/2005 | Hirabayashi | |
| 7,318,584 | B2 * | 1/2008 | Kato et al. | 270/58.11 |
| 7,472,899 | B2 * | 1/2009 | Moriyama et al. | 270/58.08 |
| 2001/0022579 | A1 | 9/2001 | Hirabayashi | |
| 2007/0020007 | A1 | 1/2007 | Azuma | |
| 2009/0250861 | A1 * | 10/2009 | Kimura | 270/58.08 |

FOREIGN PATENT DOCUMENTS

| | | | |
|---|---|---|---|
| JP | 3441897 | A | 4/1998 |
| JP | 2003-241460 | A | 8/2003 |
| JP | 2006-193283 | A | 7/2006 |

OTHER PUBLICATIONS

English language abstract for JP-10-109804 published Apr. 28, 1998 (which corresponds to JP-3441897-A).

* cited by examiner

*Primary Examiner* — Patrick Mackey

(74) *Attorney, Agent, or Firm* — Harness, Dickey & Pierce, PLC

(57) ABSTRACT

A sheet processing apparatus includes: a staple tray on which sheets are stacked temporarily and stapled after being aligned together and from which the stapled sheets are discharged to a discharge tray; a discharger to discharge the sheets to the staple tray; a rear end reference against which rear ends of the sheets are abutted to be aligned together; a returner to return the sheets discharged by the discharger and to align the sheets together in a conveying direction based on the rear end reference fence; a lifter to lift and lower the returner with respect to a sheet; and a guide configured to guide the sheets toward the rear end reference fence when the sheets are returned and to be lifted and lowered in synchronization with the lifting and lowering by the lifter.

7 Claims, 5 Drawing Sheets

SHEET RETURNING UNIT FOR POST PROCESSING APPARATUS

CROSS-REFERENCE TO RELATED APPLICATIONS

The present application claims priority to and incorporates by reference the entire contents of Japanese Patent Application No. 2009-224410 filed in Japan on Sep. 29, 2009.

BACKGROUND OF THE INVENTION

1. Field of the Invention

The present invention relates to a sheet processing apparatus that performs a certain process on a sheet recording medium (referred to as "sheet" in this specification) that has been conveyed and an image forming apparatus that includes this sheet processing apparatus inside its body, such as a copier, a printer, a facsimile machine, or a digital MFP.

2. Description of the Related Art

So-called sheet processing apparatuses or sheet post-processing apparatuses, which are each arranged subsequently to an image forming apparatus and which perform at least one of aligning, sorting, stapling, and folding with respect to sheets printed by the image forming apparatus, are in widespread use. Most of these apparatuses perform alignment upon sorting, stapling, and folding. The alignment can be carried out in a sheet conveying direction or in a direction orthogonal to the sheet conveying direction. In the alignment in the sheet conveying direction, a rear end of a sheet is usually abutted against a rear end reference fence to carry out the alignment of sheets on a rear-end basis.

Known examples of this type of technique include the inventions disclosed in Japanese Patent Application Laid-open No. 2003-241460, Japanese Patent Application Laid-open No. 2006-193283, and Japanese Patent No. 3441897. Japanese Patent Application Laid-open No. 2003-241460 describes an example of an internally-discharging-type image forming apparatus having: an operation panel and an image reading unit for reading image data of an original, which are both positioned at an upper part of the apparatus main body; and an image forming unit, which performs imaging on a transfer sheet according to the image data from the image reading unit and which is disposed below the operation panel and the image reading unit. The transfer sheet on which an image has been formed is discharged onto a discharge tray provided in an internal open section, which is between the image reading unit and the image forming unit and which has a conveying path and a discharging space that are inside the apparatus main body.

Japanese Patent Application Laid-open No. 2006-193283 describes a sheet processing apparatus that swings a stacking surface of a processing tray when a sheet is discharged and when the sheet is aligned, to solve a problem of the sheet barely being able to return by its own weight, causing improper alignment when a temporary stacking tray is approximately horizontal.

Japanese Patent No. 3441897 discloses a sheet post-processing apparatus including a bifurcating claw, which is disposed near a downstream end of a conveying roller for conveying and discharging a copy sheet to a staple tray and near the staple tray and which performs switching between a non-staple conveying path and a staple conveying path. The bifurcating claw, being switched towards the staple conveying path, guides the copy sheet discharged onto the staple tray along a lateral surface thereof. The bifurcating claw is usually positioned in a direction to open the non-staple conveying path. As a staple mode is selected and a copy sheet is conveyed from an image forming apparatus, the bifurcating claw is rotated towards the staple conveying path to open the staple conveying path, and when the copy sheet is discharged to the staple tray, the bifurcating claw returns towards the non-staple conveying path to close the staple conveying path. This is repeated copy sheet by copy sheet.

Japanese Patent Application Laid-open No. 2003-241460 discloses a so-called internal discharge type image forming apparatus, but not an internally installed sheet post-processing apparatus. Japanese Patent Application Laid-open No. 2006-193283 discloses a structure to resolve the improper alignment in the temporary accumulation tray, but the structure is not the type to perform the alignment by causing the sheet to abut on the rear-end basis. Japanese Patent No. 3441897 discloses the sheet post-processing apparatus that repeats the operation of switching the sheet conveying directions sheet by sheet, but does not make any reference to sheet guides used in the switching operation and the downsizing of that guiding structure.

SUMMARY OF THE INVENTION

It is an object of the present invention to at least partially solve the problems in the conventional technology.

According to an aspect of the present invention, a sheet processing apparatus includes: a staple tray on which sheets conveyed from a previous unit are stacked temporarily and stapled after being aligned together and from which the stapled sheets are discharged to a discharge tray; a discharging unit configured to discharge a sheet to the staple tray; a rear end reference against which a rear end of the sheet is abutted to be aligned; a sheet returning unit configured to return the sheet discharged by the discharging unit and to align the sheet in a sheet conveying direction based on the rear end reference fence; a lifting unit configured to lift and lower the sheet returning unit with respect to the sheet; and a guiding unit configured to guide the sheet toward the rear end reference fence when the sheet is returned and to be lifted and lowered in synchronization with the lifting and lowering by the lifting unit.

According to another aspect of the present invention, an image forming apparatus includes the sheet processing apparatus in a space inside a main body of the image forming apparatus.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
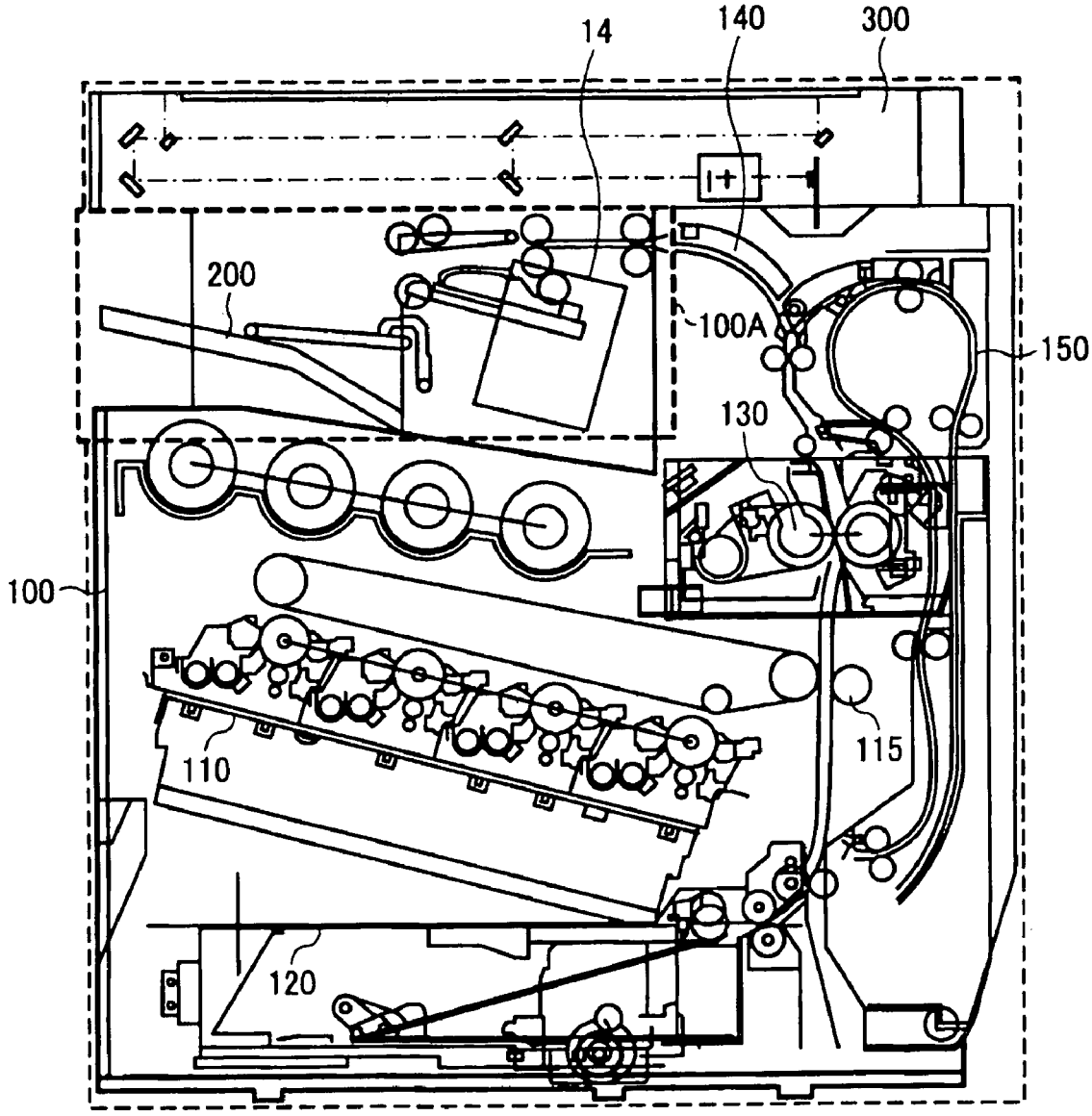
FIG. 1 is a front view of a schematic configuration of an image forming apparatus according to an embodiment of the present invention.

An embodiment of the present invention is described below with reference to the drawings. In the following description, equivalent elements are appended with same reference numerals and redundant description is omitted as appropriate.

FIG. 1 is a front view of a schematic configuration of an image forming apparatus according to an embodiment of the present invention. In FIG. 1, the image forming apparatus according to the embodiment includes an image forming apparatus 100, a post-processing apparatus 200 that is a sheet processing apparatus, and an image reading apparatus 300.

The image forming apparatus 100 substantially includes an image forming unit 110 including a four-color tandem image forming unit, a transfer unit 115 that transfers an image formed by the image forming unit 110, a feeding unit 120 that feeds a sheet to the transfer unit 115, a fixing unit 130 that fixes the image transferred by the transfer unit 115, a discharging unit 140 that discharges the sheet on which the image has been fixed, and a reversing unit 150 that reverses the sheet and leads it to the transfer unit 115 when an image is to be formed also on the back surface of the sheet. The functions and structures of these elements are known, and therefore, descriptions thereof are omitted.

The image reading apparatus 300 includes a first mirror to a third mirror, leads reflected light from an original to a photoelectric converter such as a charge-coupled device (CCD) with a reduction optical system, performs digitalization and predetermined image data correction, and transmits data usable as print data to a controller (not illustrated) of the image forming apparatus 100.

Figure 2:
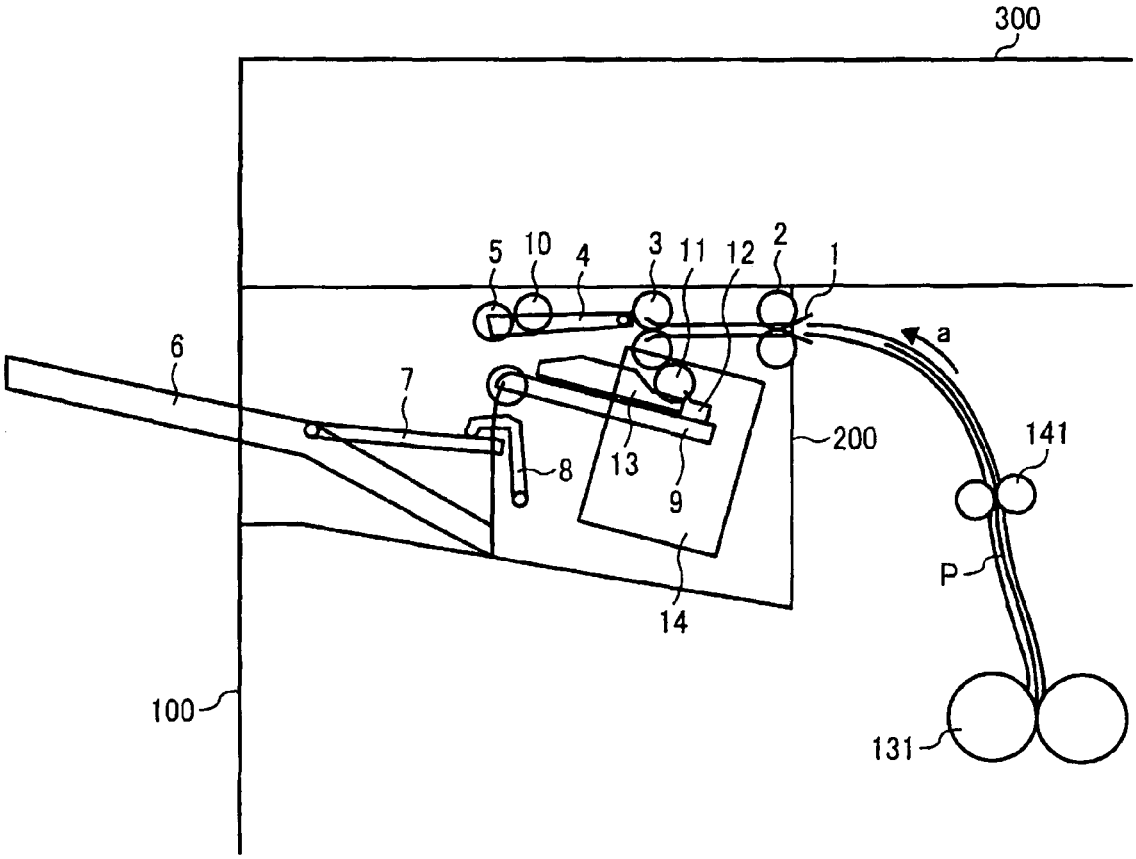
FIG. 2 is a front view of a schematic configuration of a post-processing apparatus illustrated in FIG. 1.

FIG. 2 is a front view of a schematic configuration of the post-processing apparatus 200. The post-processing apparatus 200 is a compact post-processing apparatus installed in a space between the image forming apparatus 100 and the image reading apparatus 300, that is, in an internal space 100A.

The post-processing apparatus 200 includes two trays, which are a staple tray 9 on which sheets are temporarily stacked for stapling the sheets and a discharge tray 6 on which a sheet or a bundle of sheets discharged is stacked. The staple tray section includes: a tapping roller 10, a rear end returning roller 11, and a rear end reference fence 12 that align the sheets on the staple tray 9 in a sheet conveying direction (sub-scanning direction); a jogger fence 13 that aligns the sheets in a direction orthogonal to the sheet conveying direction (main scanning direction); guide plates 1, entrance rollers 2, staple discharging rollers 3, and an opening and closing discharge guide plate 4, which are provided in this order from the inlet along the conveying path; and a discharging roller 5 provided at an opening and closing end of the discharge guide plate 4. The tapping roller 10 is provided with a tapping roller arm 15 as described with reference to FIGS. 3A and 3B below, a tapping solenoid (not illustrated), and a tapping motor (not illustrated). The tapping solenoid lifts the tapping roller arm 15, and the tapping motor drives the tapping roller 10 that is in contact with a sheet to bring the sheet towards the rear end reference fence 12. The sheet is further abutted against the rear end reference fence 12 by the rear end returning roller 11 and alignment in the sheet conveying direction (longitudinal direction) of the sheet is done. The tapping roller 10 is supported by a free end of the tapping roller arm 15 and is swingably supported at a swing end 15*a*.

The jogger fence 13 sandwiches both sides of the sheet from a direction orthogonal to the sheet conveying direction, aligns the sheet in the direction orthogonal to the sheet conveying direction (width direction), and is reciprocated for contact and separation by a jogger motor (not illustrated). A stapler 14 is provided at a rear end portion of the staple tray 9, and a staple process is performed on a bundle of sheets aligned by the rear end reference fence 12 and the jogger fence 13 in both of the length direction and the width direction.

The opening and closing discharge guide plate 4 changes the interval between a pair of discharging rollers 5 at a discharge outlet when a sheet is discharged onto the discharge tray 6 and is driven by a discharge opening and closing motor.

A rear end presser 8 that detects a sheet surface height and presses the rear end of a sheet is provided in the discharge tray 6 section so as to maintain heights of the top surface of sheets stacked and a discharge section constant. The discharge tray 6 is provided with a discharge tray movable unit 7 that repeats a lifting action per predetermined number of sheets by a lifting motor (not illustrated). The free end of the discharge tray movable unit 7 is set closer to the rear end presser 8, and a sheet is aligned by abutting the rear end of the sheet against the rear end presser 8 provided in the post-processing apparatus 200. A swing fulcrum of the discharge tray movable unit 7 is set at a preset position in a main body of the discharge tray 6. The discharge tray movable unit 7 is supported at the swing fulcrum and the height upon stacking is adjustable. The discharge tray movable unit 7 is driven to be lifted by a driving motor in a driving section (not illustrated).

Although not illustrated, the post-processing apparatus 200 is provided with sheet detecting sensors used in controlling of elements at necessary positions along the sheet conveying path, as appropriate.

Each of the image forming apparatus 100, the post-processing apparatus 200, and the image reading apparatus 300 includes a control circuit not illustrated. Each control circuit includes a central processing unit (CPU), a read-only memory (ROM), and a random access memory (RAM). Each CPU loads computer program codes stored in the corresponding ROM into the corresponding RAM, and executes control based on a corresponding computer program using the RAM as a work area and as a data buffer. The post-processing apparatus 200 and the image reading apparatus 300 are connected to the control circuit of the image forming apparatus 100 via an interface, and transmit and receive necessary control information. The image reading apparatus 300 also transmits print (image) data to be printed to the image forming apparatus 100.

The CPU of the post-processing apparatus 200 causes each element to operate based on post-process instructing information transmitted from the control circuit of the image forming apparatus 100 and detection outputs output from sheet detecting sensors arranged at appropriate positions of itself, and executes a post-process instructed by the image forming apparatus 100 with respect to the sheet.

In the internally installed post-processing apparatus 200 configured as above, when straightly discharging, a sheet P conveyed through main body fixing rollers 131 and main body discharging rollers 141 in a direction of arrow "a" enters from the guide plates 1, is sequentially conveyed through the entrance rollers 2 and the staple discharging rollers 3, and as the opening and closing discharge guide plate 4 is closed, is discharged onto the discharge tray 6 via the discharging rollers 5. Every time several sheets are discharged, the discharge tray movable unit 7 is lowered once and lifted again with the rear end of the sheet held by the rear end presser 8, which is retracted to a position not obstructing discharge of the sheet while the rear end of the sheet is passing through the discharging rollers 5. The rear end presser 8 operates sheet by sheet. Although not illustrated, the rear end presser 8 detects the height of the sheet surface.

During stapling discharge, a sheet enters from the guide plates 1, is sequentially conveyed through the entrance rollers 2 and the staple discharging rollers 3, and falls onto the staple tray 9. After that, the tapping roller 10 is operated to cause, together with the rear end returning roller 11, the rear end of the sheet to abut against the rear end reference fence 12, and to align the sheet in the length direction. The sheet is then aligned in the width direction by the jogger fence 13. The same operations are repeated until the last sheet is stacked. When the last sheet has been stacked, stapling by the stapler 14 is performed, the opening and closing discharge guide plate 4 is closed, and the bundle of sheets is discharged onto the discharge tray 6 by the discharging rollers 5. The discharge tray movable unit 7 is driven by the driving motor of the driving unit to be lowered once, and is lifted again with the rear end of the bundle of sheets held by the rear end presser 8 that is retracted to the position not obstructing the discharge of the sheet while the sheet bundle is passing through the discharging rollers 5.

Figure 3A:
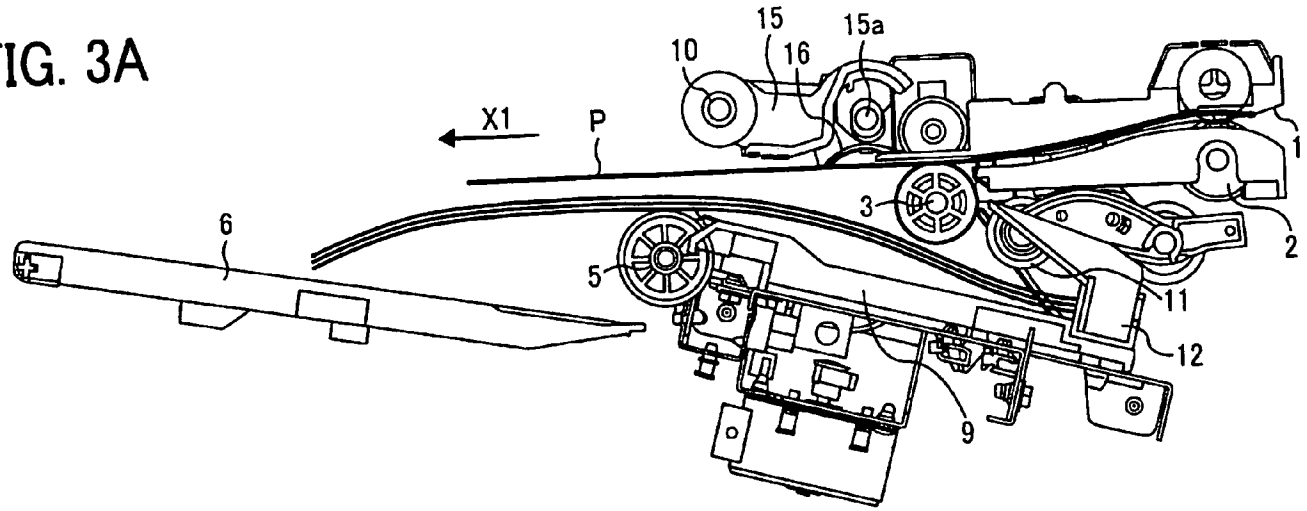
FIGS. 3A and 3B are diagrams for explaining an operation of a structure for guiding a sheet toward a staple tray according to the embodiment.
Figure 3B:
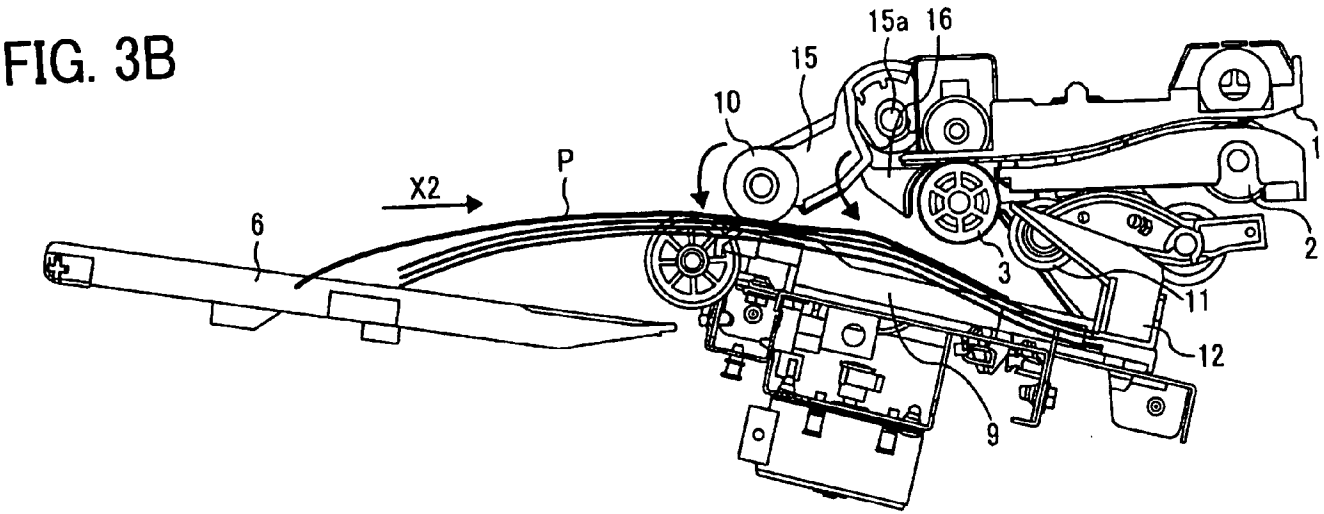

FIGS. 3A and 3B are diagrams for explaining an operation of a structure for guiding a sheet toward the staple tray. FIG. 3A illustrates the sheet P being conveyed in a discharge direction, and FIG. 3B illustrates the sheet P being conveyed toward the staple tray.

As illustrated in FIGS. 3A and 3B, a mechanism that guides the sheet P toward the staple tray 9 includes the tapping roller 10, the tapping roller arm 15, and a rear end holding claw 16. This mechanism is arranged downstream of the staple discharging rollers 3 in the sheet conveying direction, and at this position, the direction in which the sheet P is conveyed (the direction of arrow X1) is reversed (to the direction of arrow X2) to convey the sheet P toward the staple tray 9. The rear end holding claw 16 is a member that guides the sheet P to be conveyed toward the staple tray 9, and disposed between the staple discharging rollers 3 and the tapping roller 10 configured to align the sheet P. The tapping roller 10 is supported at the swing end 15*a* of the tapping roller arm 15 for allowing the tapping roller 10 to swing, and the staple tray 9 for aligning the sheet P is disposed below it. The discharging rollers 5 configured to discharge a bundle of sheets onto the discharge tray 6 are arranged at an end downstream in the sheet conveying direction of the staple tray 9. The rear end holding claw 16 is provided coaxially with the swing end 15*a* of the tapping roller arm 15. When the tapping roller arm 15 is rotated downward to perform a tapping operation, a part of the tapping roller arm 15 pushes a part of the rear end holding claw 16 to cause the rear end holding claw 16 to be rotated to the position illustrated in FIG. 3B in synchronization. The rear end holding claw 16 thus functions as a guide for the sheet P. When the tapping roller arm 15 returns upward, the rear end holding claw 16 also returns to its home position illustrated in FIG. 3A along with the returning of the tapping roller arm 15.

In other words, before accepting the sheet P, the tapping roller 10 and the rear end holding claw 16 are retracted to positions not obstructing conveyance of the sheet P. In this example, the tapping roller 10 and the rear end holding claw 16 are retracted upward (FIG. 3A). When the sheet P passes through the conveying path and is discharged by the staple discharging rollers 3, the tapping roller arm 15 is lowered. By the tapping roller arm 15 being lowered, the tapping roller 10 and the rear end holding claw 16 are lowered as well, and by the sheet P being nipped between the staple tray 9 and the tapping roller 10, a conveying force is obtained, and the sheet P is aligned by being caused to abut against the rear end reference fence 12.

The rear end holding claw 16 is arranged to prevent the rear end of the sheet from being carried back into the conveying path between the guide plates 1 near the entrance when the direction of the sheet P is switched back by the tapping roller 10. The rear end holding claw 16 is lifted when the front end of the sheet is passing (retracted as in FIG. 3A), and lowered after the front end of the sheet has passed (FIG. 3B). In this embodiment, the rear end holding claw 16 is lifted and lowered in synchronization with the lifting and lowering of the tapping roller arm 15 as described above.

Figure 4:
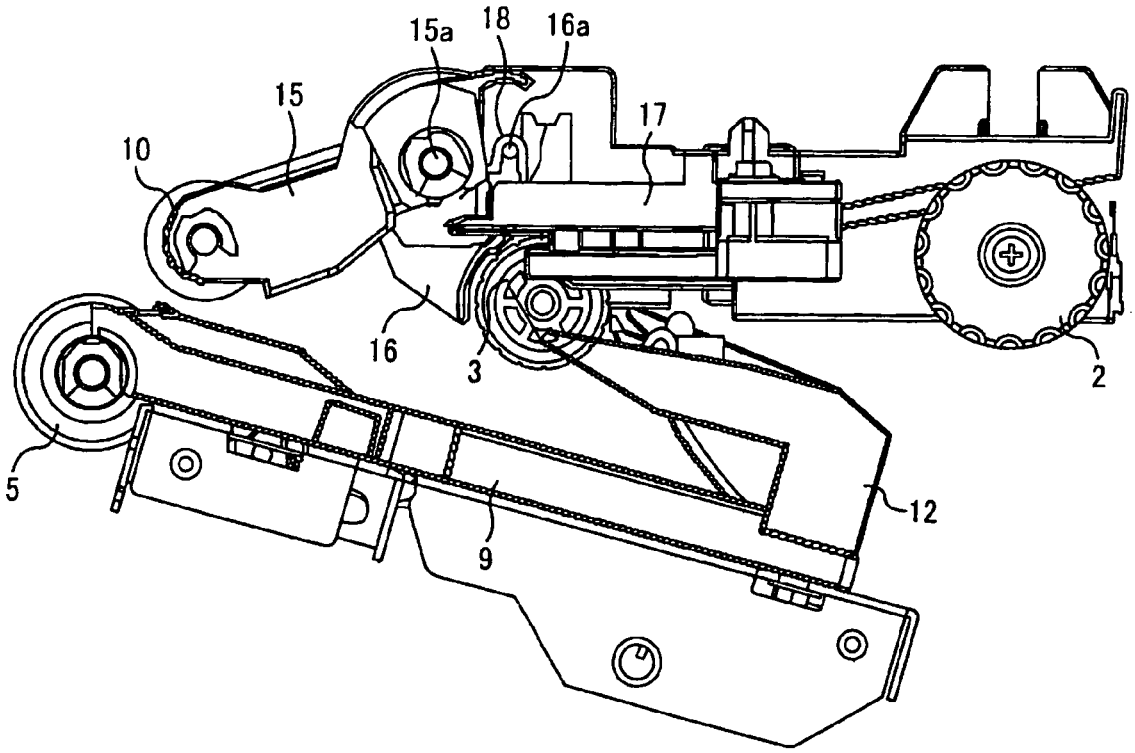
FIG. 4 is a diagram of another structure for attaching a rear end holding claw.

FIG. 4 is a diagram of another structure for attaching the rear end holding claw 16. As illustrated in FIG. 4, the rear end holding claw 16 may be supported swingably by a discharge guide plate 17 arranged further upstream of the swing end 15*a* of the tapping roller arm 15 in the sheet conveying direction. As understood from FIG. 4, the swing axis 16*a* of the rear end holding claw 16 is positioned between the swing axis 15*a* of the tapping roller arm 15 and the rotation axes of the staple discharging rollers 3. By this arrangement, the length in the sheet conveying direction is further reducible and thus greater space saving than the example illustrated in FIGS. 3A and 3B is achievable.

Figure 5A:
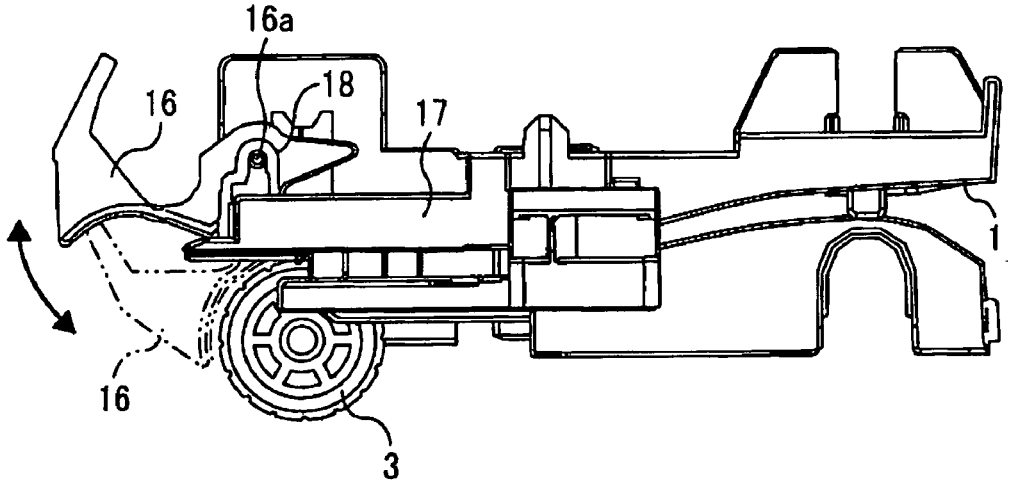
FIGS. 5A and 5B are diagrams for explaining an operation of the rear end holding claw illustrated in FIG. 4.
Figure 5B:
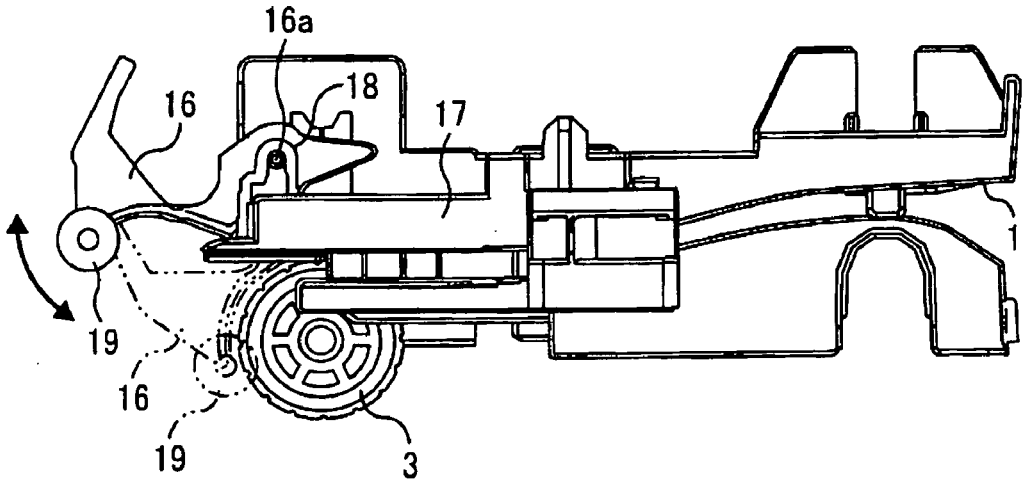

FIGS. 5A and 5B are diagrams for explaining an operation of the rear end holding claw 16 illustrated in FIG. 4. As illustrated in FIGS. 5A and 5B, the swing axis 16*a* of the rear end holding claw 16 is supported swingably about a fulcrum 18 at a top surfaces of the discharge guide plate 17 located upstream in the conveyance direction of the sheet P. By this arrangement, the structure around the fulcrum 18 is able to be simplified and no rotating member needs to be coaxially installed, in contrast to the example illustrated in FIGS. 3A and 3B. Therefore, the assembly is simplified and the cost is able to be reduced. The rear end holding claw 16 is lifted and lowered in synchronization with the lifting and the lowering of the tapping roller arm 15 in the same manner as in the example illustrated in FIGS. 3A and 3B. Such operations of the rear end holding claw 16 and the tapping roller arm 15 are achieved mechanically by an interdependent mechanical system causing them to work with each other, such as an engaging mechanism or a cam mechanism. The tapping roller arm 15 is lifted and lowered by a solenoid, for example, as mentioned earlier.

In FIG. 5B, a rotating body 19 freely rotatable by an external force may be provided at a point in the rear end holding claw 16, illustrated in FIG. 5A, that comes in contact with the sheet P. Consequently, the contact state between the sheet P and the rear end holding claw 16 is converted from sliding load into rolling load, and the conveyance of the sheet P is facilitated. As a result, the possibility of sheet jamming or damage on a sheet surface is minimized. Furthermore, in FIGS. 5A and 5B, the swing axis 16*a* is supported freely rotatably about the fulcrum 18, and performs the lifting and lowering operations as indicated by arrows and the rear end holding claw 16 is lifted in cooperation with the lifting of the tapping roller arm 15 (rotated in the clockwise direction in FIGS. 5A and 5B), but the rear end holding claw 16 may be configured, such that its engagement with the tapping roller arm 15 is released and the rear end holding claw 16 is lowered by its own weight.

In the present embodiment, the post-processing apparatus 200 is arranged in the so-called internal space that is the space between the image reading apparatus 300 and the main body of the image forming apparatus 100. However, the present invention may be implemented by attaching the post-processing apparatus 200 to a lateral surface of the image forming apparatus 100.

As described above, according to the embodiment, the effects below are achieved.

1) Because the rear end holding claw 16 that is a guiding member operates under the tapping roller arm 15 in cooperation with the tapping roller arm 15, downsizing of the machine is possible, and a driving source for the guiding member is not required.

2) Because the rear end holding claw 16 is disposed between the staple discharging rollers 3 and the tapping roller 10 in the sheet conveying direction, and lifted and lowered between the staple discharging rollers 3 and the bottom surface of the tapping roller arm 15 in cooperation with the lifting and lowering of the tapping roller arm 15, the height of the machine is reducible.

3) When the rear end holding claw 16 is configured to be lifted in cooperation with the tapping roller arm 15 and to be lowered by its own weight, the driving source for the rear end holding claw 16 is not required.

4) When the rear end holding claw 16 is supported swingably by the discharge guide plate 17 arranged upstream of the swing axis 15*a* of the tapping roller arm 15 in the sheet conveying direction, the form is able to be simplified and reduction in costs and space saving are achievable.

5) When the rotating body 19 is arranged at the tip of the rear end holding claw 16 (the end coming in contact with a sheet), rolling contact with the sheet is achieved and thus the conveyance of the sheet is facilitated.

6) When the sheet post-processing apparatus is installed in a discharging section of the internal space of the image forming apparatus, the mechanism of the sheet post-processing apparatus is accommodated within the projected floor area of the image forming apparatus. Therefore, a series of processes including the post processing of sheet is possible within the installation area occupied by the image forming apparatus.

According to an aspect of the present invention, when the direction in which the sheets are discharged is reversed to align the sheets, it is possible to improve the guiding performance of the sheet while achieving downsizing and space saving.

In the embodiment of the present invention described above, the discharge tray corresponds to reference numeral 6, the staple tray corresponds to reference numeral 9, the sheet processing apparatus corresponds to reference numeral 200, the discharging unit corresponds to staple discharging rollers 3, the rear end reference fence corresponds to reference numeral 12, the sheet returning unit corresponds to the tapping roller 10, the guiding unit corresponds to the rear end holding claw 16, the lifting unit corresponds to the tapping roller arm 15, the arm member corresponds to the tapping roller arm 15, the driving mechanism corresponds to the tapping solenoid not illustrated, the discharge guide plate corresponds to reference numeral 17, the rotating body corresponds to reference numeral 19, the internal space corresponds to the internal space 100A, and the image forming apparatus corresponds to reference numeral 100.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A sheet processing apparatus including a staple tray on which sheets conveyed from a previous unit are stacked temporarily and stapled after being aligned together and from which the stapled sheets are discharged to a discharge tray, the sheet processing apparatus comprising:

a discharging unit configured to discharge a sheet to the staple tray;

a rear end reference fence against which a rear end of the sheet is abutted to be aligned;

a sheet returning unit configured to return the sheet discharged by the discharging unit and to align the sheet in a sheet conveying direction based on the rear end reference fence;

a lifting unit configured to lift and lower the sheet returning unit with respect to the sheet; and a guiding unit configured to guide the sheet toward the rear end reference fence when the sheet is returned and to be lifted and lowered in synchronization with the lifting and lowering by the lifting unit, wherein the guiding unit is provided coaxially with the lifting unit.

2. The sheet processing apparatus according to claim 1, wherein the lifting unit includes:

an arm member including a free end configured to support the sheet returning unit and a base end configured to swingably support the arm member; and a driving mechanism configured to drive the arm member to swing upward and downward with respect to a top surface of the staple tray.

3. The sheet processing apparatus according to claim 1, wherein the guiding unit is configured to retract when a front end of the sheet is passing and to be lowered by its own weight after the sheet passes.

4. The sheet processing apparatus according to claim 1, wherein the guiding unit is arranged between the discharging unit and the sheet returning unit in the sheet conveying direction.

5. The sheet processing apparatus according to claim 1, wherein the guiding unit is swingably supported by a discharge guide plate provided upstream of the guiding unit.

6. The sheet processing apparatus according to claim 1, further comprising a rotating body provided at an end of the guiding unit that comes in contact with the sheet.

7. An image forming apparatus comprising the sheet processing apparatus according to claim 1 in a space inside a main body of the image forming apparatus.

* * * * *